United States Patent [19]

Fairbank

[11] 4,275,833

[45] Jun. 30, 1981

[54] SNOW-MAKING APPARATUS

[76] Inventor: Brian H. Fairbank, P.O. Box 143, Hancock, Mass. 01237

[21] Appl. No.: 113,477

[22] Filed: Jan. 21, 1980

[51] Int. Cl.[3] ..... A01G 15/00

[52] U.S. Cl. ..... 239/2 S

[58] Field of Search ..... 239/25, 14, 268, 269, 239/281, 430, 433, 566, 567, 602; 62/74

[56] References Cited

U.S. PATENT DOCUMENTS

| | | | |
|---|---|---|---|
| 2,952,413 | 9/1960 | Jepson | 239/602 |
| 2,962,091 | 11/1960 | Sabel | 239/602 |
| 3,464,625 | 9/1969 | Carlsson | 239/2 S |
| 3,559,888 | 2/1971 | Miklos | 239/602 |
| 4,145,000 | 3/1979 | Smith et al. | 239/14 |
| 4,194,689 | 3/1980 | Ash | 239/2 S |

*Primary Examiner*—James B. Marbert

*Attorney, Agent, or Firm*—Richard A. Menelly

[57] ABSTRACT

An improved, portable and directional snow-making apparatus of the type consisting of an inner pipe and an outer jacket provides an optimum geometry to both the inner pipe and outer jacket for optimum snow formation. Directional facility is attained by means of a carefully-controlled ratio between the apertures in the outer pipe relative to the apertures in the inner pipe, as well as a dual pair of adjustable legs. The diameter of the pipe apertures controls the spray pattern of the snow, whereas the legs can be adjusted to accommodate the snow formation relative to the pitch of the ski trail.

5 Claims, 7 Drawing Figures

SNOW-MAKING APPARATUS

BACKGROUND OF THE INVENTION

The invention relates to snow-making apparatus, in general, and in particular, to an improved nozzle arrangement for controlling the size and configuration of the snow crystals and their direction of generation.

A known type of snow-making apparatus employs an inner water-carrying pipe within an air-supplied outer jacket. Registration between the apertures in the inner pipe and in the outer jacket assures that a fine mist of atomized water particles is continuously available for freezing and forming snow crystals upon contact with frigid air. The large-scale models currently available provide tremendous quantities of snow but are bulky to handle. Problems involved with known snow-making apparatus include both the difficulty in forming a particular dry type of snow powder and in directing the snow powder upon a desired portion of the ski slopes and trails.

With temperatures in the vicinity of around 5° C. to 10° C. above zero, the apertures in the outer jacket tend to freeze and interrupt the snow-making process. Another problem frequently encountered with large-scale snow-making apparatus is the freeze-up which occurs within the inner water-carrying pipe after several hours of use in a frigid environment.

The purpose of this invention is to provide an improved portable and directional snow-making apparatus that continues to provide substantial quantities of snow over a wide range of ambient temperatures.

SUMMARY OF THE INVENTION

The invention comprises an improved snow-making apparatus of the type consisting of an inner water pipe within an outer air jacket wherein the ratio of the water pipe to air jacket is 1–3 and wherein the ratio of the apertures in the inner water pipe to the apertures in the outer air jacket is 3–5. In order to provide a uniform snow distribution pattern, the number of apertures in both the inner water pipe and the outer air jacket are kept to 1.25 per linear foot, and in order to compensate for the pitch of the ski trail, the legs are adjustable. One embodiment utilizes a curvilinear inner water pipe within a curvilinear outer air jacket to prevent freeze-up when snow making is required for long periods of application and when a dry type "Colorado dust" snow particle is desired.

DESCRIPTION OF THE PREFERRED EMBODIMENT

Figure 1:
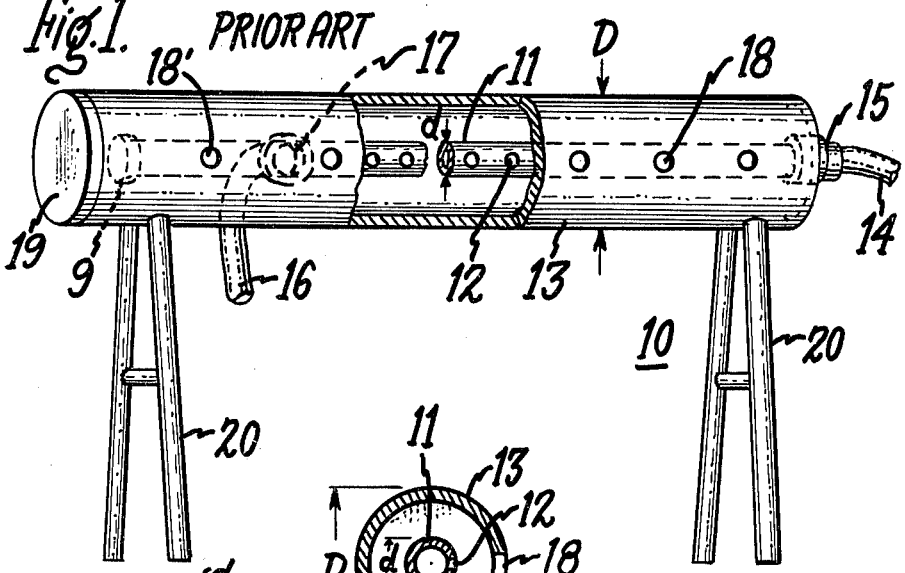
Fig. 1. PRIOR ART
FIG. 1 is a front perspective view in partial section of a snow-making apparatus according to the prior art.
Figure 2:
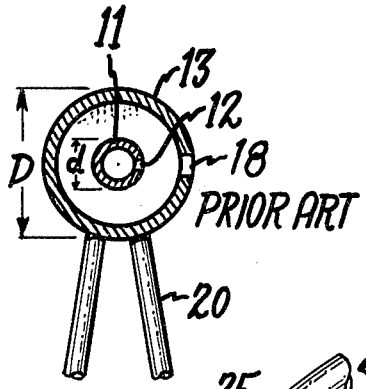
Fig. 2. PRIOR ART
FIG. 2 is a cross-sectional view of the apparatus of FIG. 1.

In order to fully describe the improved portable and directional snow-making apparatus of the invention, reference is made to a known dual-pipe snow-making nozzle shown in FIG. 1. A nozzle or gun 10 consisting of an inner water pipe 11 having a plurality of apertures 12 and a diameter d is concentrically arranged within an outer air jacket 13, having a diameter D. Water is supplied to water pipe 11 by means of a water hose 14 and fitting 15. Air is supplied to outer air jacket 13 by means of air hose 16 and fitting 17 located intermediate the ends of outer jacket 13. A plurality of apertures 18 are located along the linear extent of outer jacket 13 in registry with a plurality of apertures 12 along the linear extent of water pipe 11. Inner water pipe 11 is sealed at one end by means of pipe cap 9 and outer jacket 13 is sealed at one end by means of end cap 19. Nozzle 10 is carried by a pair of supports 20 located at each end. The relationship between diameter D of outer jacket 13 and diameter d of water pipe 11 can be seen by referring to FIG. 2. The registration between apertures 12 of water pipe 11 and apertures 18 of air jacket 13 provides for the ready transfer of water, under pressure, from water pipe 11 through apertures 12 during the snow-making process. The size of apertures 12 is only slightly larger than the size of apertures 18 which causes some back pressure to occur between both apertures. In operation, water is supplied through water hose 14 and into water pipe 11 by means of fitting 15. When the water completely fills water pipe 11 from fitting 15 to pipe cap 19, for example, water then exits by means of apertures 12 to within the confines of outer jacket 13. The compressed air within outer jacket 13 forces the water that exits from apertures 12 out through apertures 18 in a fine mist which freezes on contact with the frigid atmospheric air to form particles of snow. The diameter D of outer jacket 13 is in the order of 4 inches, and the diameter of water pipe 11 is generally in the order of 1½ inches. Large "wet type" snow crystals are usually obtained with this snow-making nozzle.

Figure 3:
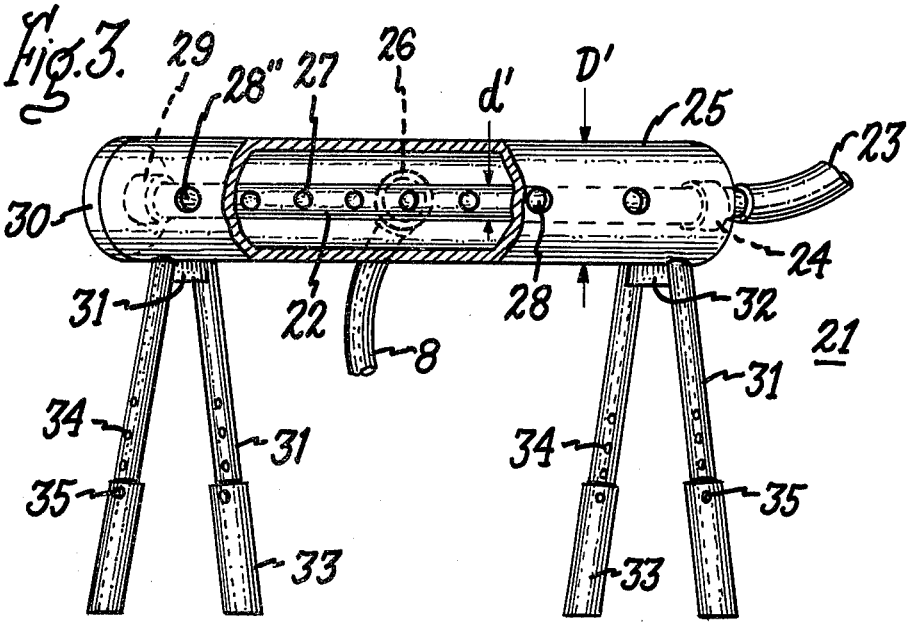
FIG. 3 is a front perspective view of the improved snow-making apparatus according to the invention.

The improved nozzle or gun 21 of the invention can be seen by referring to FIG. 3 wherein a curvilinear inner water pipe 22, having a diameter d' of 1 inch is concentrically aligned within a curvilinear outer air jacket 25 having a diameter D' equal to 3 inches. Water, under pressure, is supplied to water pipe 22 by means of a water hose 23 and a fitting 24. The number of apertures 27 extending along the linear extent of water pipe 22 and air jacket 25 is selected as an optimum of 5 when the length of water pipe 22 is 4 feet resulting in 1.25 apertures per linear foot. This is to insure a uniform distribution of snow along the entire length of nozzle 21 under operating conditions. Compressed air is supplied to outer air jacket 25 by means of air line 8, connected to jacket 25 by means of fitting 26. Compressed air exits from outer jacket 25 by means of a plurality of apertures 28 selected to correspond exactly to the number of apertures 27 existing along water pipe 22. The ratio of the diameters of apertures 27 along water pipe 22 to apertures 28 along outer air jacket 25 is specifically selected to be in a ratio of 3–5 in order to assure the transport of pressurized water between water pipe 22 and jacket 25 and from air jacket 25 into the atmosphere without freeze-up over a wide range of ambient temperatures. This is an important feature of the improved snow-distribution apparatus of the instant invention.

When the ratio is less than 3–5, insufficient water is supplied to provide an optimum quantity of snow formation. When the ratio is in excess of 3–5, ice crystals tend to form, rather than fine snow particles suitable for downhill skiing. In order to prevent freeze-up within inner water pipe 22, pipe plug 29 is situated at one end of water pipe 22 proximate to the last aperture 28'. When a pipe cap 9, similar to that described for the configuration depicted in FIG. 1 is used, water tends to accumulate between the last aperture 18' and the pipe cap causing freeze-up to occur and eventually closing off the last aperture. Although an end cap 30 is used to close off one end of air jacket 25 and to ensure the quantity of compressed air between water pipe 22 and outer air jacket 25 for the transfer of a mixture of water and air through apertures 28 as described earlier, other means, such as welding, can be employed. In order to direct the flow of newly-formed snow along a controlled angle of inclination which corresponds to the slope of the ski trail, a pair of adjustable legs 31 are connected proximate each end of outer air jacket 25 and are connected to jacket 25 by means of supports 32. Adjustable legs 31 consist of a fixed leg 34 and a moveable leg 33. When the moveable leg portion 33 is at the desired extent along fixed portion 34, a pin 36 is inserted within holes 35 to secure the legs together. The adjustable legs 31 provide an important benefit to the nozzle of the invention, since the degree of pitch must be carefully controlled along the downhill course of the ski trail.

Figure 4:
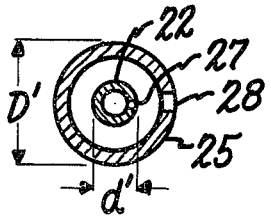
FIG. 4 is a cross-sectional view of the snow-making apparatus of FIG. 3.

The registration between apertures 27 of inner water pipe 22 and apertures 28 of outer air jacket 25 is shown in FIG. 4. An optimum transfer of vaporized mist between water pipe 22 and outer air jacket 25 occurs when the diameter of apertures 27 is 3/16's of an inch and the diameter of apertures 28 is 5/16's of an inch.

The optimum total quantity of snow generated per horsepower of electrical energy used to operate both the water pumps and the air compressors (not shown) for a plurality of nozzles 21 used in a parallel arrangement from a single compressor and water supply occurs when the ratio of inner water pipe 22 to outer air jacket 25 is 1–3. For the embodiment depicted in FIG. 3, the diameter d' of water pipe 22 is 1 inch and the diameter D' of outer air jacket 25 is 3 inches.

Figure 6:
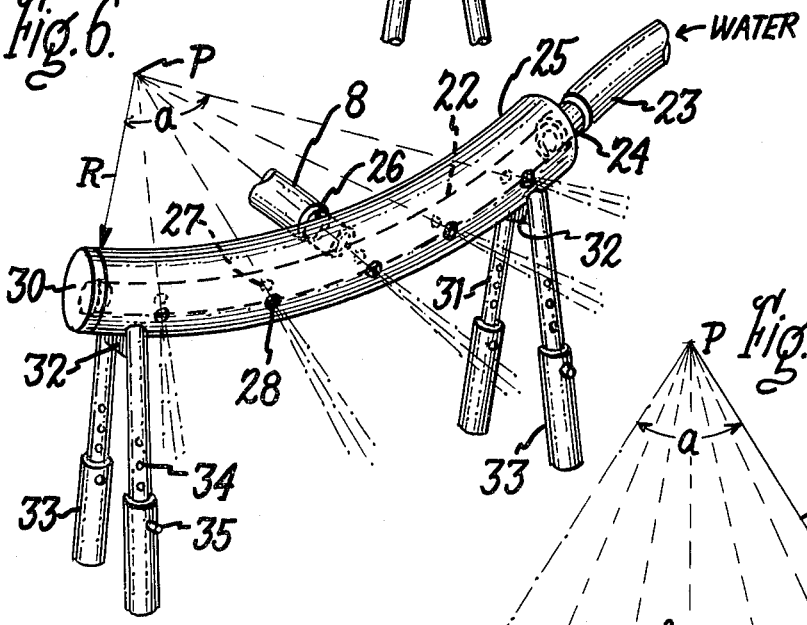
FIG. 6 is a top sectional view of the embodiment of FIG. 5.
Figure 5:
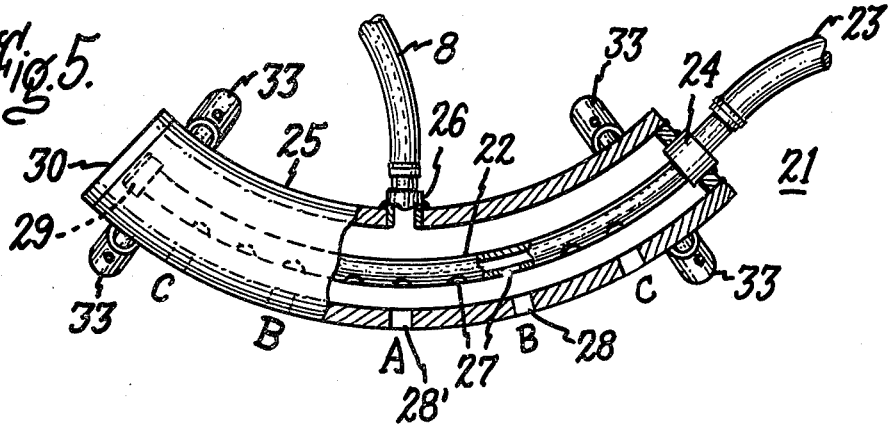
FIG. 5 is a top sectional view of a further embodiment of the snow-making apparatus according to the invention.

The improved nozzle or gun 21 of FIG. 3 having a curvilinear configuration is shown in greater detail in FIG. 5 wherein a central aperture 28' in outer curvilinear air jacket 25 situated at A extends beyond apertures 28 situated at B, and apertures 28 situated at B extend beyond apertures 28 situated at C. This configuration also includes an inner curvilinear water pipe 22 and apertures 27 as described for the embodiment depicted earlier in FIG. 3. The curvilinear configuration depicted in FIG. 5 can be used for extended periods of time without freezing or becoming clogged, whereas linear embodiments can only be operated for a few hours before some of the apertures begin to freeze up and therefore require frequent maintenance procedures to free up the clogged apertures, particularly when temperatures approach 5° to 10° C. The reason for the ability of the curvilinear configuration to operate without freeze-up is not well understood. It is believed, however, that the direction of spray is such that the mist streams exiting from each of the individual apertures 28 in curvilinear outer jacket 25 do not contact and interfere with each other before the snow-transformation process has occurred. A further distinguishing characteristic not found with linear nozzles is the formation of "Colorado powder" which is a light, dry snow crystal particularly suited for downhill skiing. This particular snow formation is unusually difficult to obtain with conventional snow-making equipment. The radius of curvature R for the embodiment depicted in FIG. 6 is approximately 8 feet when the length of inner water pipe 22 and outer air jacket 25 is 4 feet. The angle of curvature a which is defined as the included angle formed from a radius R extending from each end of air jacket 25 to a point P measures approximately 24°.

The linear configuration depicted in FIG. 1 produces "wet" snow for the same conditions of temperature, water pressure, and air pressure. This indicates, therefore, that the radius of curvature R of the outer air chamber 25 and inner water pipe 22 of the improved nozzle 21 of FIG. 6 can be varied in order to control the degree of "wetness" or "dryness" of the particular type snow desired. Since the radius of curvature of a straight line is defined as infinite, the snow generated from a nozzle having a greater radius of curvature would produce wetter snow than a nozzle having a lesser radius. It is within the scope of the instant invention to provide a single snow-making nozzle having a flexible outer air jacket 25 and a flexible inner water pipe 22 such that the radius of curvature R can be adjusted to provide a particular type of snow crystal under various conditions of temperature, humidity, water pressure within water pipe 22, and air pressure within air jacket 25. When only slight variations in radius of curvature R are desired, the material used for fabricating water pipe 22 and air jacket 25 can comprise a thin-walled steel or a heavy-walled plastic configuration. When larger variations in radius of curvature R are desired, both water pipe 22 and outer air jacket 25 can comprise a braided configuration similar to the type of braided metals employed within flexible compressed air applications.

Figure 7:
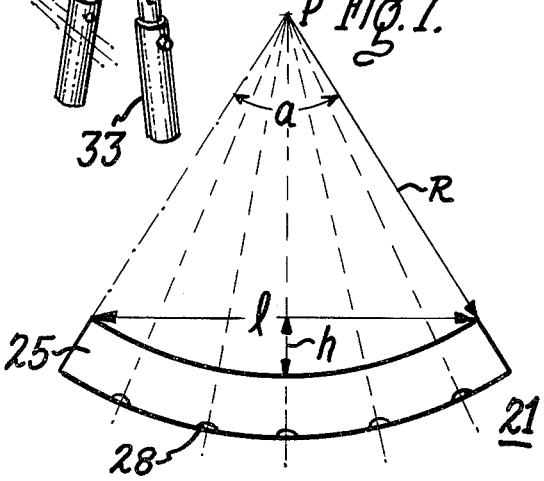
FIG. 7 is a schematic representation of the relationship between radius of curvature and length for the curvilinear embodiment depicted in FIG. 6.

The radius of curvature R shown in FIG. 6 can be measured by referring to the geometric representation shown in FIG. 7.

Dimension l equal to 38 inches represents the shortest distance between the ends of outer air chamber 25 and h equal to 2 inches represents the distance from line l to the center of the arc described by the curved region of outer air chamber 25. For the operational embodiments of this invention, R can be calculated by the simplified expression R equals the ratio of l squared to 8 times h. This expression is an approximation of the radius of curvature R when h is small relative to l. As described earlier, the size of the generated snow particles and its degree of dryness can be controlled by varying the radius of curvature R from infinity as for a linear snow nozzle 10, shown in FIG. 1, where the resultant snow particles are large and contain a high water content to the curvilinear configuration shown in FIG. 6, for example, wherein the radius of curvature R is approximately equal to 8 feet and the snow particles are smaller and dryer than the particles obtained from the nozzle depicted in FIG. 1. The beneficial properties described for the curvilinear snow nozzle of the invention, such as small particles of dry powder and long operating periods without freeze-up, are obtained within a radius of curvature range approximated from 10 feet down to 2 feet before the emitted streams again begin to interfere with each other.

What is claimed is:

1. An improved snow-making nozzle of the type consisting of an inner water-carrying pipe having a plurality of apertures within an outer air-carrying jacket having a plurality of apertures wherein the improvement comprises:

both said inner pipe and said outer jacket having a curvilinear configuration for causing said water and air to exit in a plurality of streams which do not contact and interfere with each other until snow formation occurs, for distributing snow for long operating periods of time without freeze-up, said curvilinear inner pipe and said curvilinear outer jacket having a radius of curvature determined by the ratio of the linear separation distance h between a center portion of said outer jacket in a line l defining the shortest linear distance between the ends of said outer jacket, said inner pipe and said outer jacket have a calculated radius of curvature between 10/feet and 2 feet.

2. The improved nozzle of claim 1 wherein the ratio of the diameter of said inner pipe apertures to the diameter of said outer jacket apertures is 3 to 5.

3. The improved nozzle of claim 1 wherein one of said inner water pipe apertures is proximate one end of said pressurized air and exits through said outer jacket apertures in divergent streams to form snow powder in cold operating conditions without freeze-up.

4. The improved nozzle of claim 1 further including a pair of adjustable legs at each end for controlling the angle of snow distribution relative to a ski slope.

5. An improved method for manufacturing snow of the type consisting of transmitting water through an inner water pipe having a plurality of apertures and transmitting pressurized air through an outer air jacket having a plurality of apertures, said outer jacket apertures being larger than and in registry with said inner pipe apertures wherein the improvement comprises:

bending said inner water pipe and outer air jacket into a curvilinear configuration having a radius of curvature from 2 to 10 feet to produce a snow powder of predetermined size by causing said air and water to exit in divergent streams, said radius of curvature being determined by the ratio of the linear separation distance h between a center portion of said outer jacket and in line l defining the shortest linear distance between the ends of said outer jacket.

* * * * *